US006554326B1

(12) United States Patent
Goldman

(10) Patent No.: US 6,554,326 B1
(45) Date of Patent: Apr. 29, 2003

(54) ELECTROMAGNETIC LOCKING MECHANISM

(76) Inventor: Ilan Goldman, Hayasmin Street 3, 46631 Herzliya (IL)

( * ) Notice: Subject to any disclaimer, the term of this patent is extended or adjusted under 35 U.S.C. 154(b) by 0 days.

(21) Appl. No.: 09/646,304

(22) PCT Filed: Mar. 17, 1999

(86) PCT No.: PCT/IL99/00148

§ 371 (c)(1),
(2), (4) Date: Nov. 13, 2000

(87) PCT Pub. No.: WO99/47773

PCT Pub. Date: Sep. 23, 1999

(30) Foreign Application Priority Data

Mar. 17, 1998 (IL) ..... 123714

(51) Int. Cl.[7] ..... E05C 1/06
(52) U.S. Cl. ..... 292/144; 292/201; 292/224
(58) Field of Search ..... 292/4, 5, 144, 292/201, 207, 224

(56) References Cited

U.S. PATENT DOCUMENTS

| | | | | |
|---|---|---|---|---|
| 996,292 A | * | 6/1911 | Stephenson | 292/224 |
| 3,214,948 A | * | 11/1965 | Modrey | 70/99 |
| 3,667,793 A | * | 6/1972 | Varrin | 292/216 |
| 3,751,088 A | | 8/1973 | Schlage et al. | |
| 4,703,960 A | * | 11/1987 | Lense | 292/69 |
| 4,902,053 A | | 2/1990 | Hakkarainen et al. | |
| 5,547,130 A | * | 8/1996 | Davies | 292/265.29 |
| 5,901,992 A | * | 5/1999 | Winkler | 292/270 |

FOREIGN PATENT DOCUMENTS

| | | |
|---|---|---|
| DE | C080383 | 4/1895 |
| DE | 80383 | 4/1895 |
| DE | C195107 | 2/1908 |
| DE | 195107 | 2/1908 |
| DE | 510670 | 10/1930 |
| DE | C510670 | 10/1930 |
| EP | 0402537 | 12/1990 |
| EP | A402537 | 12/1990 |
| FR | 2686929 | 8/1993 |
| FR | A2686929 | 8/1993 |
| GB | 13633 | 5/1915 |
| GB | AP13633 | 5/1915 |
| GB | A1178110 | 1/1970 |
| GB | 1178110 | 1/1970 |

* cited by examiner

*Primary Examiner*—Gary Estremsky
(74) *Attorney, Agent, or Firm*—Birch, Stewart, Kolasch & Birch, LLP

(57) ABSTRACT

An electromagnetic locking mechanism including (a) a rotary lock bolt (65) rotatably reciprocable between a normally protruding locking position and a retracted unlocking position on a forced rotation thereof by an external opening force; (b) a lock bolt urging member (67) in continuous abutting engagement with the rotary lock bolt (65) and linearly reciprocable between a normally outwardly biased position for urging the rotary lock bolt (65) to its normally protruding locking position and a retracted position on the forced rotation of the rotary lock bolt (65); and (c) a blocking member (131) reciprocable between a blocking position in the normally protruding locking position of the rotary lock bolt (65) and an unblinking position for respectively preventing and enabling a rearward displacement of the lock bolt urging member (67) from its normally outwardly biased position to its retracted position on the forced rotation of the rotary lock bolt (65).

9 Claims, 17 Drawing Sheets

ELECTROMAGNETIC LOCKING MECHANISM

This application is the national phase under 35 U.S.C. §371 of PCT International Application No. PCT/IL99/00148 which has an International filing date of Mar. 17, 1999, which designated the United States of America.

FIELD OF THE INVENTION

The invention relates to electromechanical locking mechanisms in general and in particular to electromechanical locking mechanisms having a rotary lock bolt.

BACKGROUND OF THE INVENTION

In U.S. Pat. No. 5,134,870 to Uyeda et al, there is illustrated and described an electromagnetic locking mechanism including a rotary lock bolt governing the locking and unlocking of a door via a handle driven bolt works mechanism having a bolt works member reciprocable between first and second operative positions respectively corresponding to locked and unlocked states of the door. Alternative implementations of the electromagnetic locking mechanism are required, each suitable for use with either one or the other of a clockwise and a counterclockwise operative bolt works mechanism.

The rotary lock bolt is urged into a normally protruding locking position by a biasing spring whereby it is transversely disposed in the path of the bolt works member which slidingly abuts there against to forciby rotate the former to a substantially retracted unlocking position on the latter's displacement from its first operative position to its second operative position. To prevent an unauthorized opening of the door, rotation of the rotary lock bolt is stopped by means of a solenoid armature which is retracted on entry of an access code via a digital keypad entry device. To avoid undue shear stress on the solenoid armature during an attempted unauthorized opening i.e. when the solenoid armature is extended, the rotary lock bolt is provided with a safety notch which engages a safety key after the rotary lock bolt rotates slightly about its point of contact with the solenoid armature.

In operation, the biasing spring undesirably presents an increasing resistance from the initial contact between the bolt works member and the rotary lock bolt until the free passage of the bolt works member to its second operative position. Secondly, there is undesirable play in the bolts works mechanism before engagement between the safety notch and safety key. Lastly, engagement between the safety notch and the safety key may leave the bolt works mechanism inoperable in a so-called "deadlock state" due to the biasing spring not returning the rotary lock bolt to its normally protruding locking position on the return displacement of the bolt works member to its first operative position.

SUMMARY OF THE INVENTION

In accordance with a first aspect of the present invention, there is provided an electromagnetic locking mechanism comprising:

(a) a rotary lock bolt rotatably reciprocable between a normally protruding locking position and a retracted unlocking position on a forced rotation thereof by an external opening force;

(b) a lock bolt urging member in continuous abutting engagement with said rotary lock bolt and linearly reciprocable between a normally outwardly biased position for urging said rotary lock bolt to said normally protruding locking position and a retracted position on said forced rotation of said rotary lock bolt; and (c) a blocking member reciprocable between a blocking position in said normally protruding locking position of said rotary lock bolt and an unblocking position for respectively preventing and enabling a rearward displacement of said lock bolt urging member from said normally outwardly biased position to said retracted position on said forced rotation of said rotary lock bolt.

An electromagnetic locking, mechanism of the present invention is adapted for installation in a conventional manner in safes, vaults, strong rooms and the like having a handle driven bolt works mechanism as described hereinabove, namely, with a bolt works member for forcibly rotating the rotary lock bolt from its normally protruding locking position to its retracted unlocking position on entry of an access code. In a simplified construction, an electromagnetic locking mechanism of the present invention is suitable for use with only one type of operative bolt works mechanism, namely, either a clockwise or a counterclockwise operative bolt works mechanism. In a modified construction of an electromagnetic locking mechanism of the present invention, the positions of the rotary lock bolt and bolt lock urging member are interchangeable such that the electromagnetic locking mechanism can be installed in either a clockwise or a clockwise bolt works mechanism. An electromagnetic locking mechanism of the present invention as can other constructions of electromagnetic locking mechanisms with rotary lock bolts, for example, as illustrated and described in the aforementioned U.S. Pat. No. 5,134,870 can be preferably adapted for installation in typically smaller safes and the like which are locked and unlocked directly by a handle operated lock.

The rotary lock bolt has a cam surface in continuous abutting engagement with an abutment surface of the lock bolt urging member which is inclined with respect to the latter's direction of linear reciprocation. The lock bolt urging member is preferably normally outwardly urged by a biasing spring acting against a trailing portion thereof and compressible in a direction co-directional with the lock bolt urging member's rearward displacement. A solenoid armature constituting a blocking member of the stopping means is preferably linear reciprocable in a direction perpendicular to the lock bolt urging member's linear reciprocation. The solenoid armature is operatively associated with a lock bolt arresting member which is integrally formed with the lock bolt urging member in the simplified construction of the electromagnetic locking mechanism of the present invention and which is detachable therefrom in the modified construction of the electromagnetic locking mechanism of the present invention adaptable for use in either a clockwise or a counter clockwise operative bolt works mechanism. The solenoid armature is selectively reciprocable between an outwardly biased blocking position in the normally outwardly biased position of the lock bolt urging member and a retracted unblocking position enabling the rearward displacement of the lock bolt urging member. The solenoid is preferably a magnetically latched solenoid whilst the code entry means is preferably implemented by the data receiving means as described in PCT/IL98/00105. An electromagnetic locking mechanism of the present invention fitted with long life batteries can have a useful life of several years during which it can is be operated many thousand of times.

In operation, the solenoid armature is retracted on entry of an access for sufficient time for an external opening force applied to the rotary lock bolt to compress the biasing spring during the rearward displacement of the lock bolt urging member from its normally outwardly biased position to its retracted position. By virtue of the camming action gradually acting over a longer arm as the rotary lock bolt is gradually forced to its retracted unlocking position, the force required to compress the biasing spring correspondingly gradually becomes less. The solenoid armature presents a virtually immediate positive blocking action to an attempted unauthorized opening and also precludes the possibility of a deadlock situation from arising. In an attempted unauthorized opening of a door, the force applied against the rotary lock bolt acts internal supporting structures thereby considerably reducing the force directly applied against the solenoid armature.

In accordance with a second aspect of the present invention, there is provided an electromagnetic locking mechanism comprising:

(a) a rotary lock bolt rotatably reciprocable between a normally protruding locking position and a first retracted unlocking position on a forced rotation thereof by an external opening force;

(b) a handle operated carriage linearly reciprocable between outward and inward positions for selectively displacing said rotary lock bolt between said normally protruding locking position and a second retracted unlocking position; and (c) a blocking member reciprocable between a blocking position in said normally protruding locking position of said rotary lock bolt and an unblocking position for respectively preventing and enabling a rearward displacement of said carriage from said outward position to said inward position.

BRIEF DESCRIPTION OF THE DRAWINGS

For a better understanding of the different aspects of the present invention and to show how the same can be carried out in practice, a preferred embodiment will now be described, by way of a non-limiting example, with reference now made to the accompanying drawings, in which.

DETAILED DESCRIPTION OF THE DRAWINGS

Figure 1:
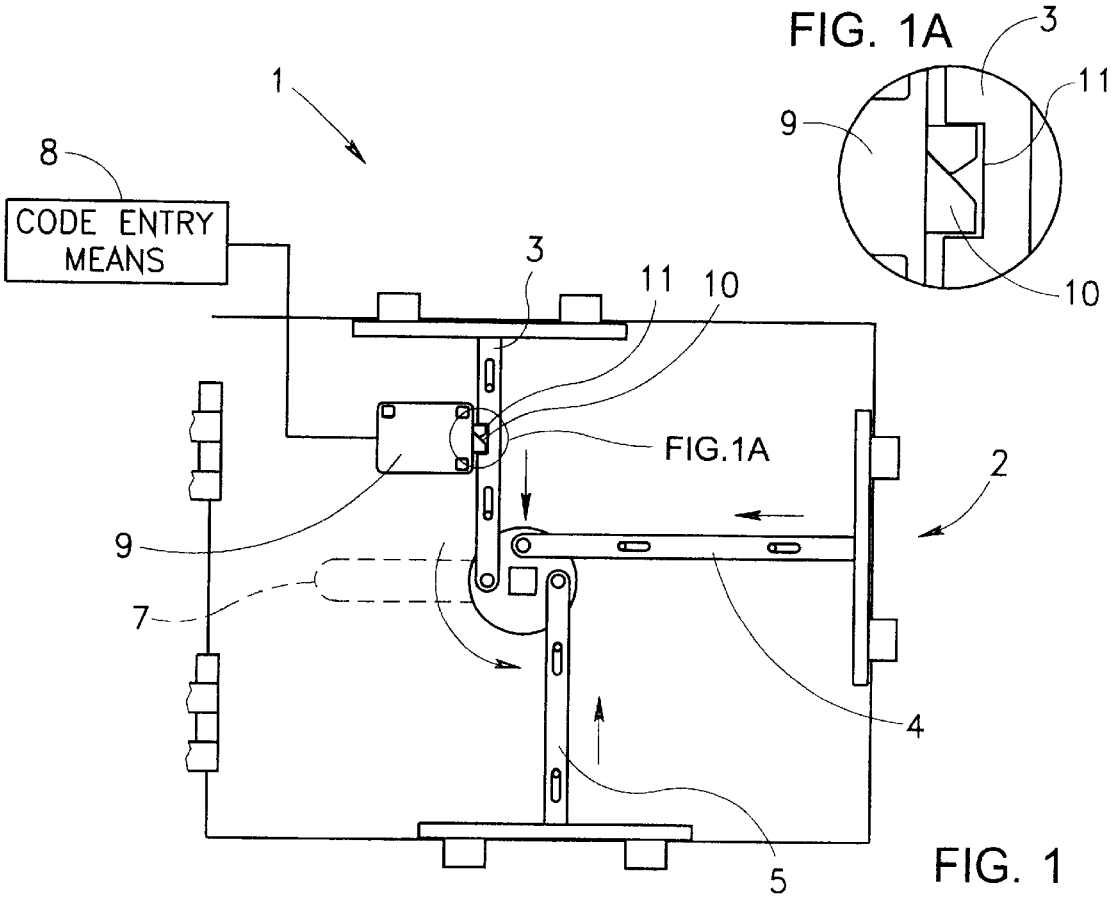
FIGS. 1 and 2 are pictorial representations of the inside surfaces of safe doors locked and unlocked by a counter clockwise operative handle driven bolt works mechanism and directly by a handle, respectively.

FIG. 1 shows the inside surface of a safe door 1 associated with a handle driven bolt works mechanism 2 whose bolt works members 3, 4 and 5 reciprocate between normally protruding locking positions and refracted unlocking positions respectively corresponding to the normally locked and unlocked states of the door. The bolt works mechanism 2 is so-called "counterclockwise operative" because its bolt works members reciprocate from their normally protruding locking positions to their retracted unlocking position on a counterclockwise rotation of a handle 7. Reciprocation of the bolt works mechanism 2 is selectively enabled on entry of an access code via a code entry means 8 by means of a lock 9 having a lock bolt 10 snugly received in a recess 11 formed in bolt works member 3.

Figure 2:
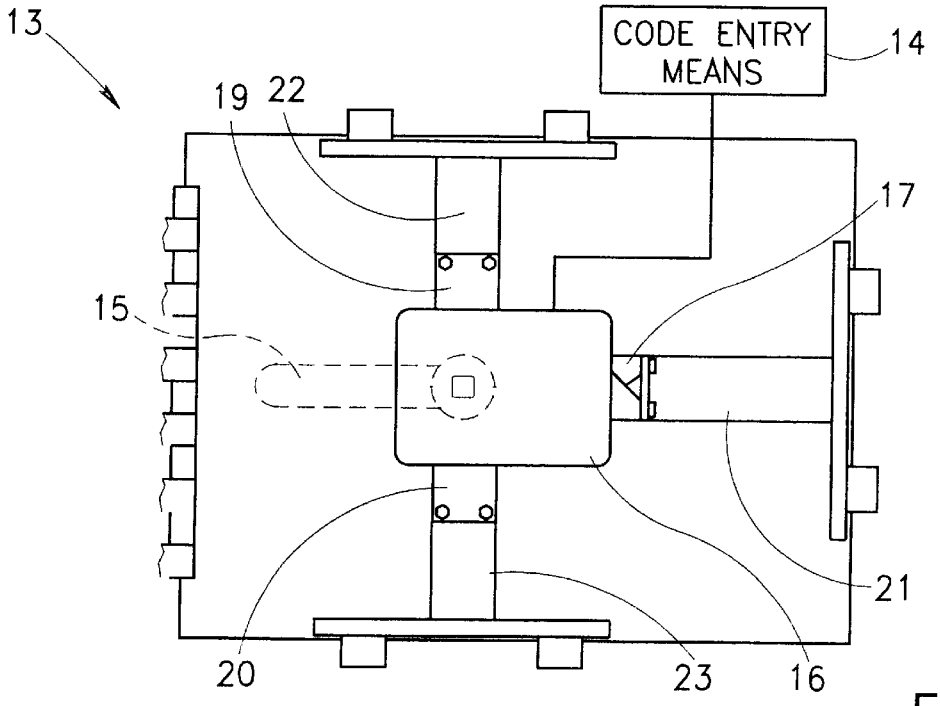

FIG. 2 shows the inside surface of a safe door 13 having a code entry means 14 and a handle 15 for directly locking and unlocking a lock 16 having a lock bolt 17 and a pair of locking members 19 and 20 respectively connected to locking bolts 21, 22 and 23, the locking bolts 21, 22 and 23 reciprocating between normally protruding locking positions and retracted unlocking positions respectively corresponding to normally locked and unlocked states of the door.

Figure 3:
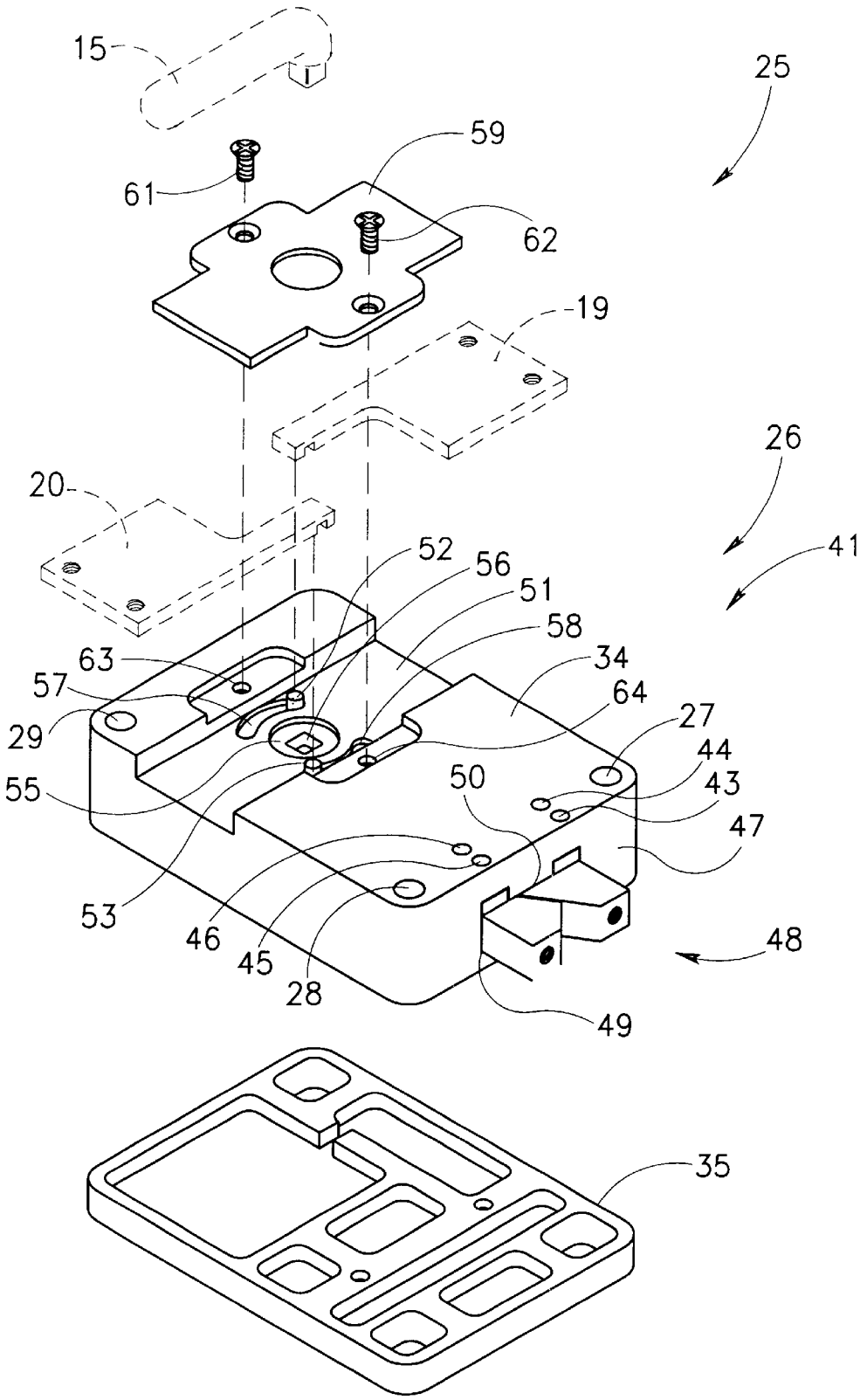
FIGS. 3 and 4 are partly exploded close-up front and rear views of a lock having an electromagnetic locking mechanism of the present invention for installation on either one of the safe doors of FIG. 1 or 2.
Figure 4:
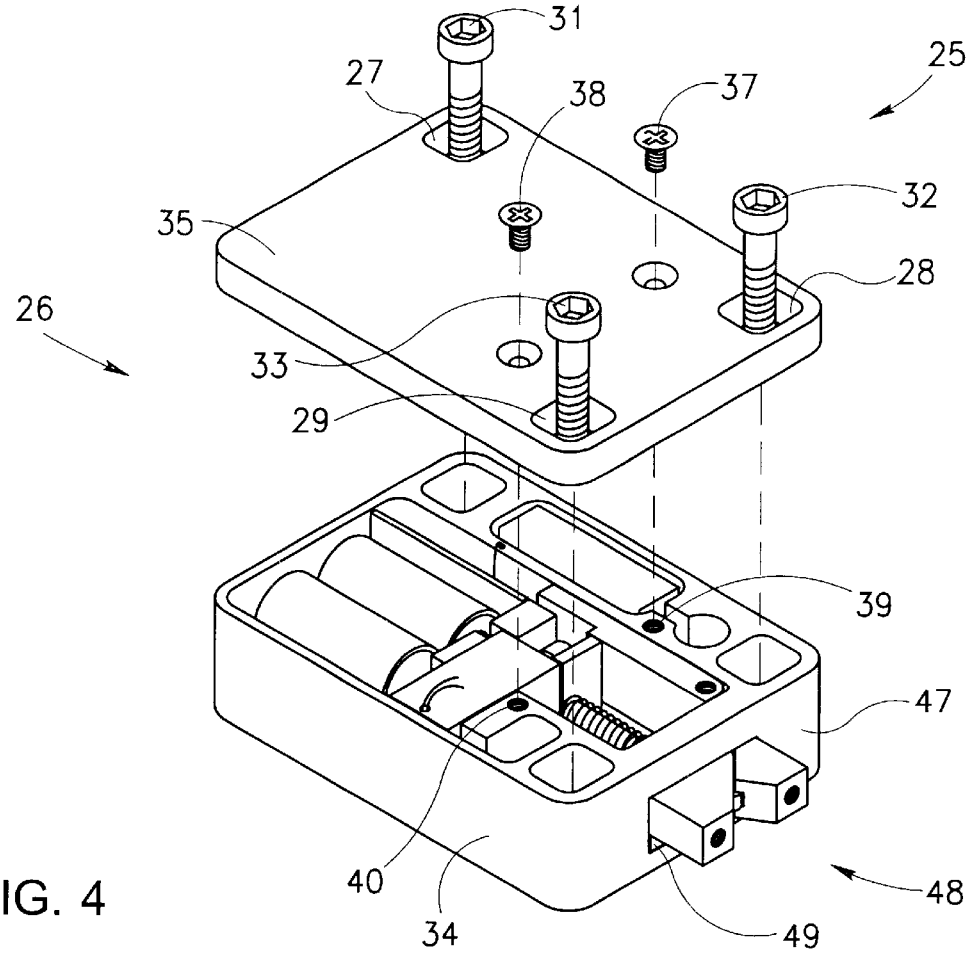

FIGS. 3 and 4 show a lock 25 constituting the locks 9 and 16 and including a lock housing 26 having throughbores 27, 28 and 29 enabling its attachment to a safe door by means of three bolts 31, 32 and 33. The lock housing 26 includes a main block 34 and a cover plate 35 for attachment to the main block 34 by means of screws 37 and 38 received by tapped bores 39 and 40 (see FIG. 4). The main block 34 includes a front surface 41 for juxtaposition against a safe door, the front surface 41 being formed with four through bores 43, 44, 45 and 46 at one end thereof adjacent a short side wall 47 formed with a generally rectangular shaped lock bolt aperture 49 and a stop 50 (see FIG. 4).

A two-piece lock bolt 48 corresponding to the lock bolts 10 and 17 protrudes through the lock bolt aperture 49. For use in connection with the safe door 13 of FIG. 2, the main block's front surface 41 is formed with a aversely disposed channel 51 for receiving the pair of locking members 19 and 20. The locking members 19 and 20 are respectively pivotally attached to diagonally opposite projections 52 and 53 formed on the underside of a rotatable disk 55 and travel along curved guides 57 and 58. The locking members 19 and 20 are held in place by a cover 59 secured to the front surface 41 by means of screws 61 and 62 received in tapped bores 63 and 64. The rotatable disk 55 has a central square aperture 56 to which is journaled the handle 15 for rotating the rotatable disk 55 for reciprocating the lock bolt 48 and the locking members 19 and 20 between their normally protruding locking position and retracted unlocking positions.

Figure 5:
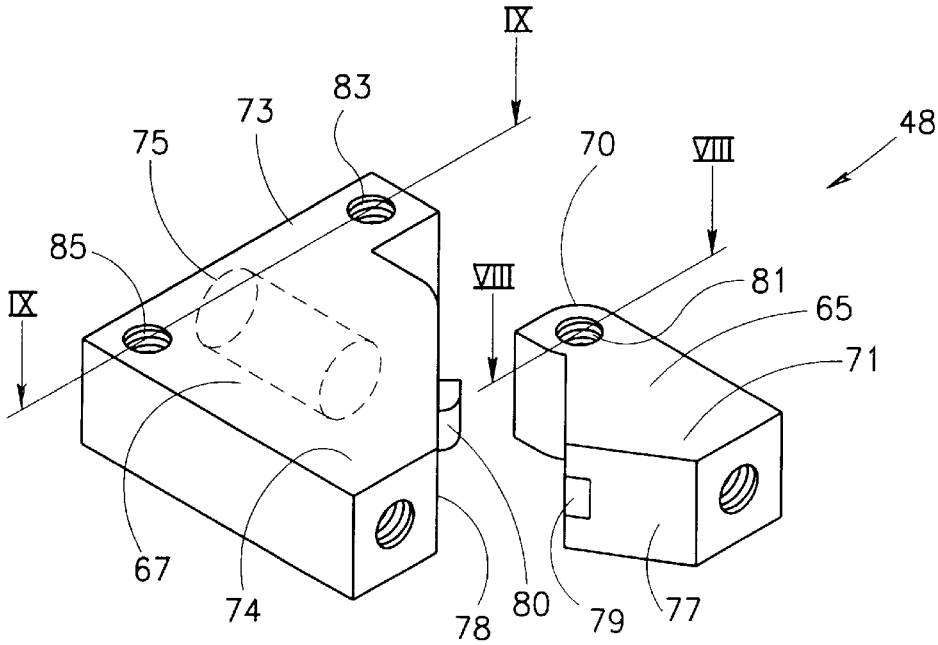
FIGS. 5, 6 and 7 are close-up, top and front views of the lock bolt of the electromagnetic locking mechanism of the present invention, respectively.
Figure 6:
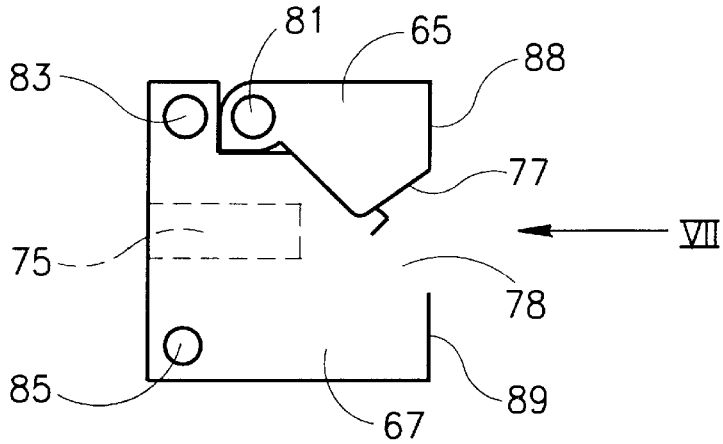
Figure 7:
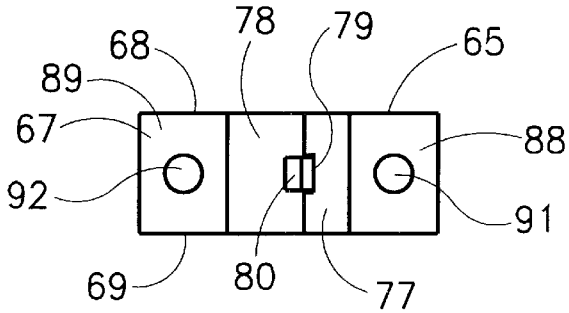

FIGS. 5–7 show that the lock bolt 48 is constituted by a substantially P-shaped rotary lock bolt 65 and a substantially right angle shaped lock bolt urging member 67 having complimentary shapes delimiting an imaginary square in a top view (see FIG. 6) and having common upper and tower surfaces 68 and 69 (see FIG. 7). The rotary lock bolt 65 has a leg portion 70 and a body portion 71 whilst the lock bolt urging member 67 has a full width trailing portion 73 and a leading portion 74. The lock bolt urging member 67 is formed with a blind bore 75 for at least partially receiving a biasing spring 76 (see FIG. 10).

The body portion 71 has a cam surface 77 which is in continuous abutting engagement with a leading portion's inclined abutment surface 78 which is substantially parallel to the imaginary square's diagonal. The cam surface 77 and the abutment surface 78 are formed with a groove 79 and matching projection 80 for facilitating a more controlled sliding engagement therebetween.

Figure 8:
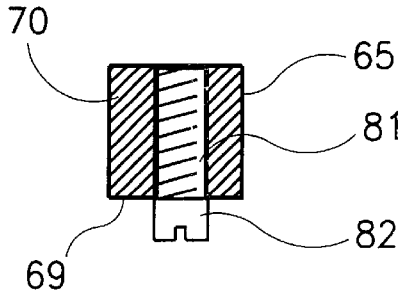
FIGS. 8 and 9 are cross section views along lines VIII—VIII and IX—IX in FIG. 5, respectively.
Figure 9:
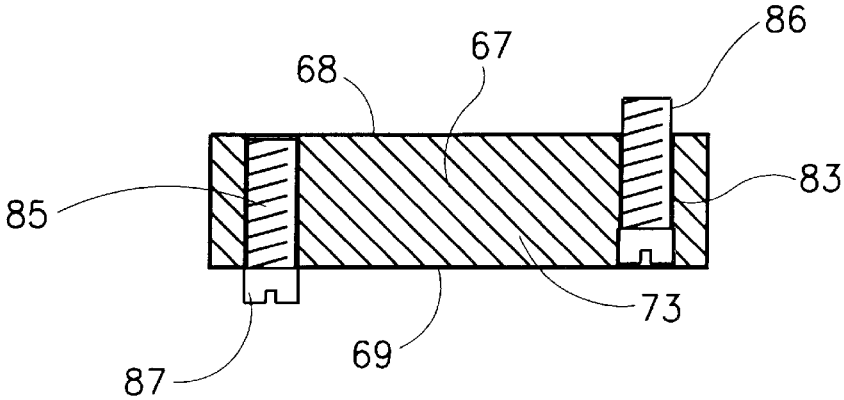

The rotary lock bolt's leg 70 is formed with a threaded through bore 81 for receiving a set screw 82 whilst the lock bolt urging members trailing portion 73 is formed with a pair of threaded through bores 83 and 85 for receiving identical set screws 86 and 87. The bores 81, 83 and 85 are such that on the full insertion of the set screws from the underside, the head of set screw 82 protrudes below the lower surface 69 (see FIG. 8) whilst a portion of the set screw 86 protrudes above the upper surface 68 and the head of the set screw 87 protrudes below the lower surface 69 (see FIG. 9).

The complimentary shapes of the locking rotary bolt 65 and the lock bolt urging member 67 have co-planar end surfaces 88 and 89 which are provided with threaded blind bores 91 and 92 by means of which the locking bolt 21 can be attached (see FIG. 2).

Turning now to FIGS. 10—13, a carriage 95 is formed with a leading portion 96 and a trailing portion 97 which is stepped relative to the leading portion 96 so as to overlie a portion of the rotatable disk 55. The leading portion 96 is bifurcated with a central web portion 98 adapted to abut against the stop 50 and lateral extensions 99 and 101 (see FIG. 12). The trailing portion 97 is provided with a notch 102 adapted to engage a projection 103 on the topside of the rotatable disk 55 such that rotation of the rotatable disk 55 reciprocates the carriage 95 between an outward position juxtaposed against the stop 50 and an inward position.

An internal wall structure 104 and a pair of internal walls 106 and 107 sideways restrain the carriage 95 during its reciprocation between its extreme outward and inward positions. A U-shaped spring 108 having one leg 109 received in an aperture 111 formed in the carriage's trailing portion 97 and its other leg 112 received in an aperture 113 formed in the internal wall structure 104 is normally biased into an open position in either one of the carriage's extreme positions.

The lateral extension 99 is formed with a pair of through bores 114 and 116 and the lateral extension 101 is formed with a single through bore 117 and a cutaway section 118. During assembly when the carriage's central web 98 is juxtaposed against the stop 50, the through bores 114, 116 and 117 respectively overlay the through bores 45, 46 and 43 whilst the cutaway section 118 overlays the through bore 44 thereby enabling insertion of the set screws 82, 86 and 87 from the main block's front surface 41.

A right angled flange 119 is provided on the one hand, for securing the rotatable disk 55 and, on the second hand, providing a storage compartment for batteries 120. The internal wall 106 is provided with a support rod 121 on which the biasing spring 76 is mounted.

Figure 15:
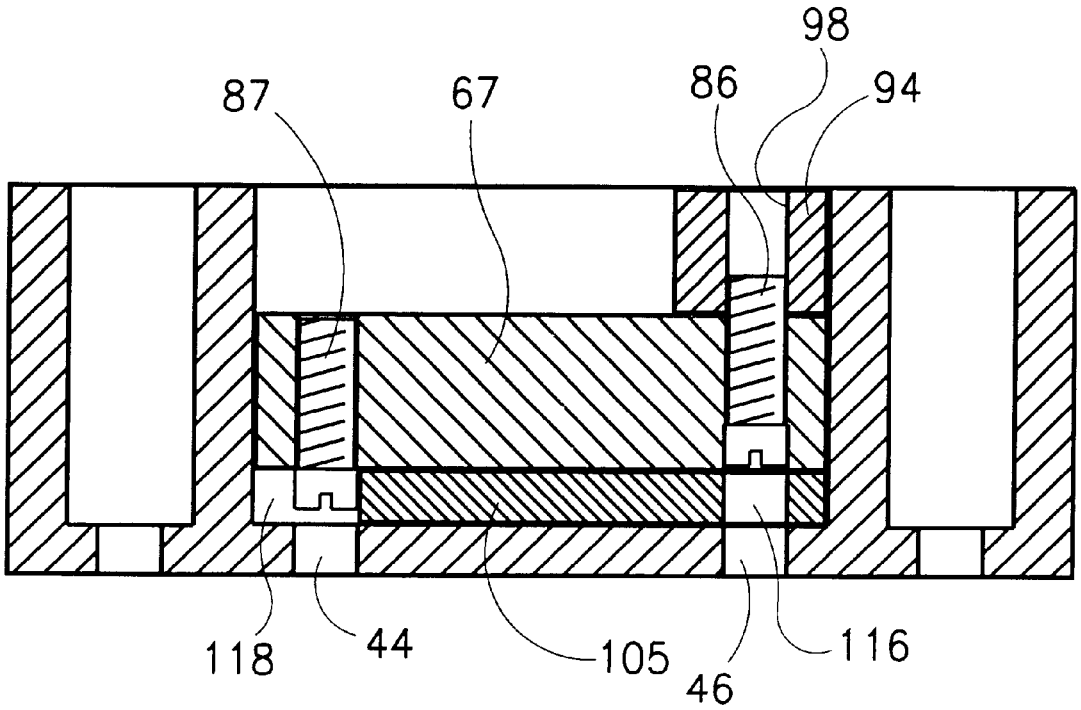

A lock bolt arresting member 122 together with the rotary lock bolt 65 and the lock bolt urging member 67 overlay the carriage 95. The lock bolt arresting member 122 is formed with a stepped leading portion 123, an intermediate portion 124 and a recessed trailing portion 126. The stepped leading portion 123 is configured to receive the left side of the trailing portion 73 of the lock bolt urging member 67 and is formed with a threaded through bore 127 for receiving the upwardly protruding portion of the set screw 86 (see FIG. 15) whereby the spring biased lock bolt urging member 67 and the 10 lock bolt arresting member 122 constitute a lock bolt urging mechanism 128 (see FIG. 12).

Figure 14:
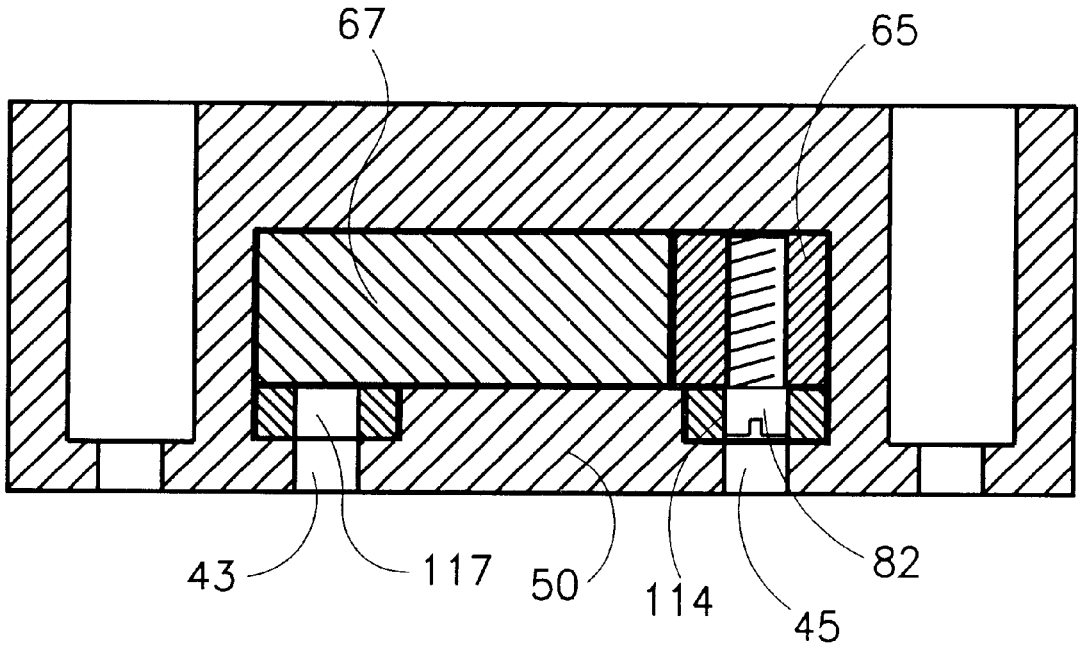
FIGS. 14 and 15 are cross section views along lines XIV—XIV and XV—XV in FIG. 13, respectively.

Under the action of the biasing spring 76, the lock bolt urging mechanism 128 is urged into a normally outwardly biased position which in turn urges the rotary lock bolt 65 into its normally protruding locking position. On a rotation force applied to the rotary lock bolt 65, it rotates about the set screw 82 which resides in the through bore 114 (see FIG. 14) so as to substantially flush with the side surface 47 in its retracted unlocking position thereby causing he lock bolt urging mechanism 128 into its retracted position against the internal wall 106. True reciprocation of the lock bolt urging mechanism 128 is facilitated by the set screw 87 sliding along the side surface of the cutaway section 118.

Figure 10:
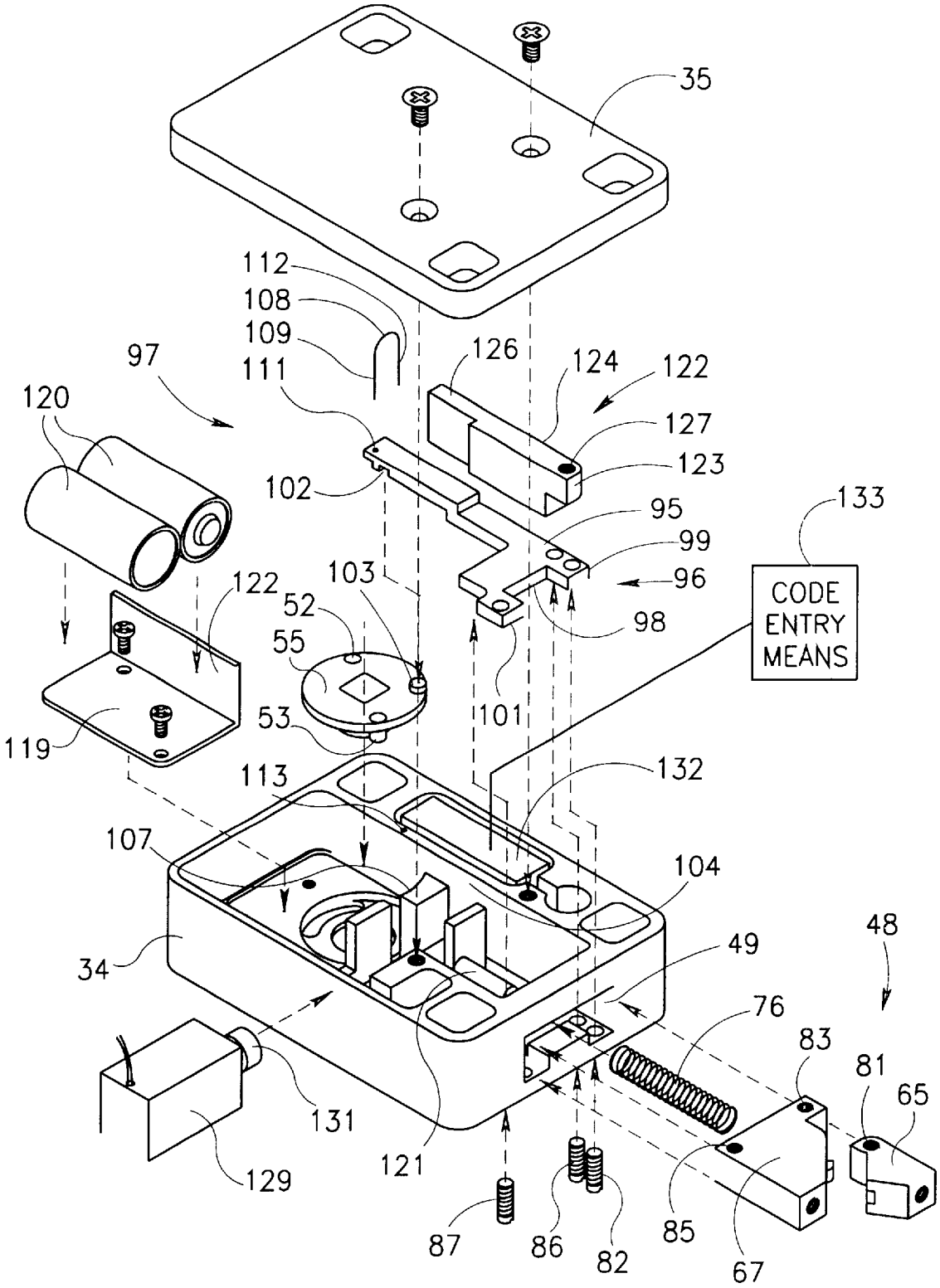
FIGS. 10 and 11 are exploded views of the electromagnetic locking mechanism of the present invention with different construction lines.
Figure 11:
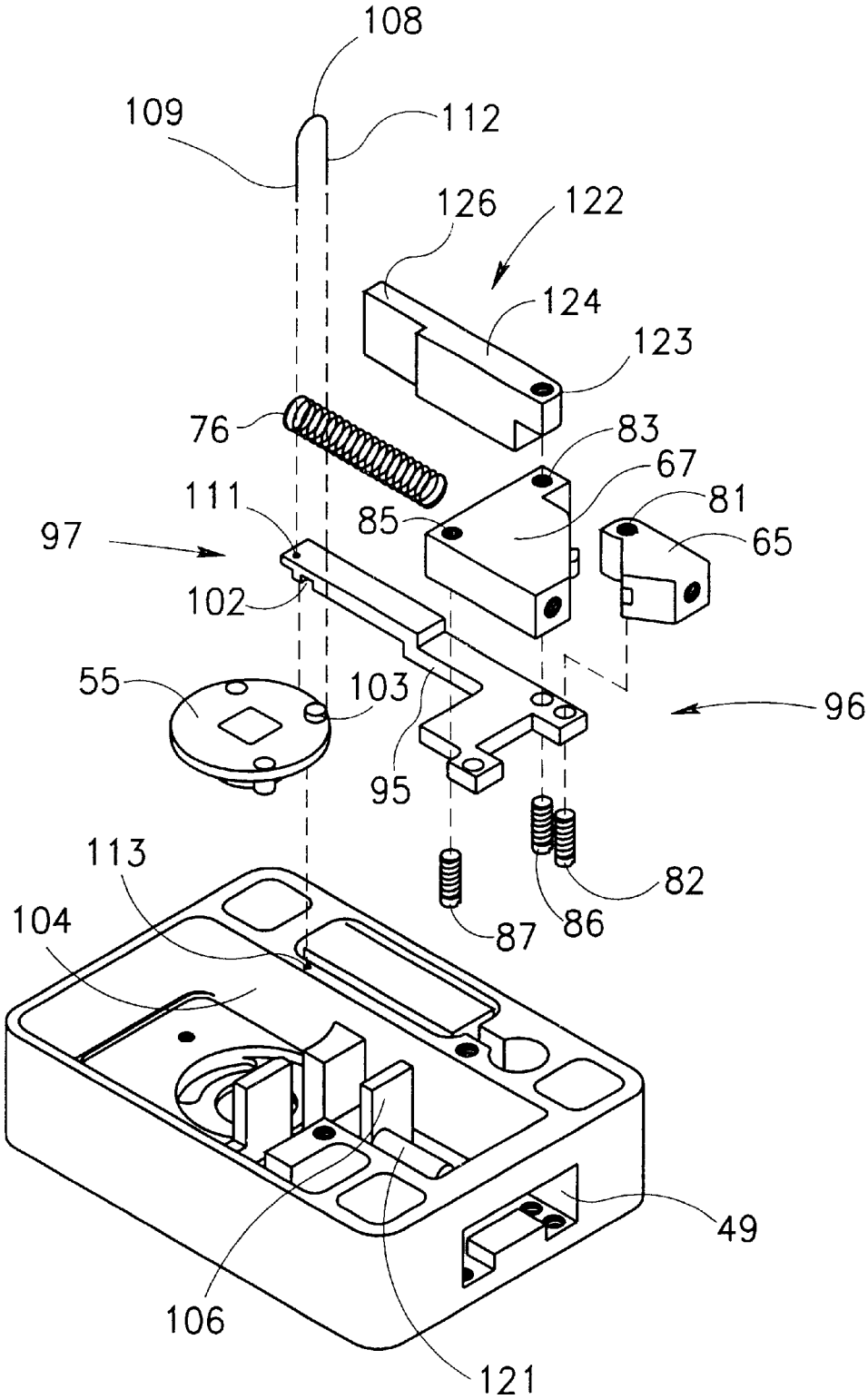
Figure 12:
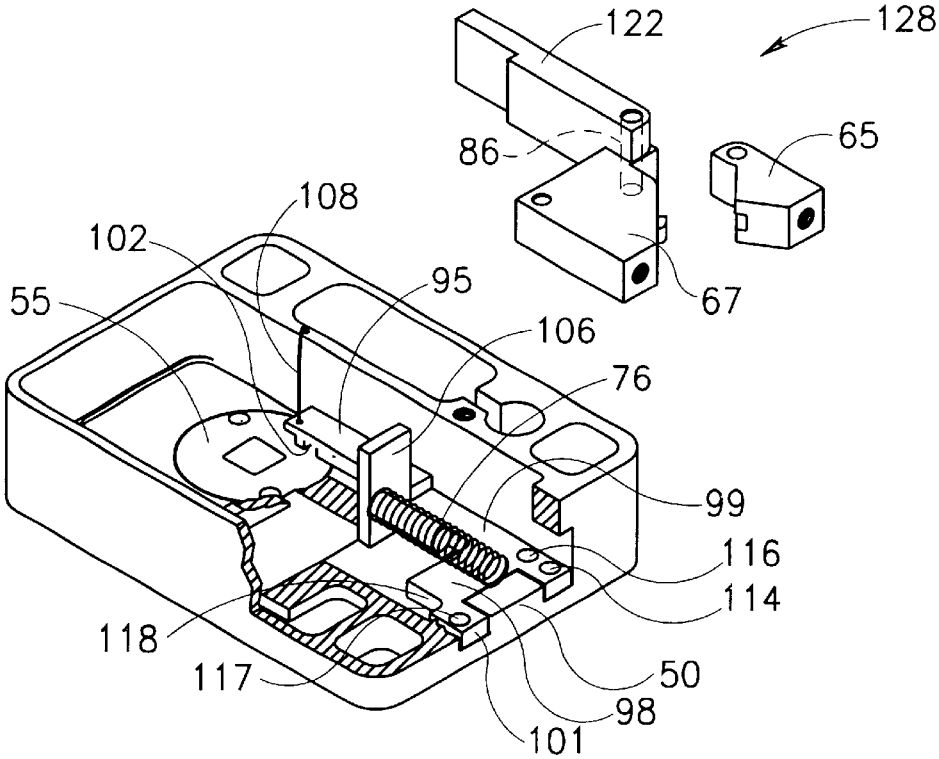
FIGS. 12 and 13 are partly cut away views of the lock of FIGS. 3 5 and 4 in partially assembled and fully assembled states, respectively.
Figure 13:
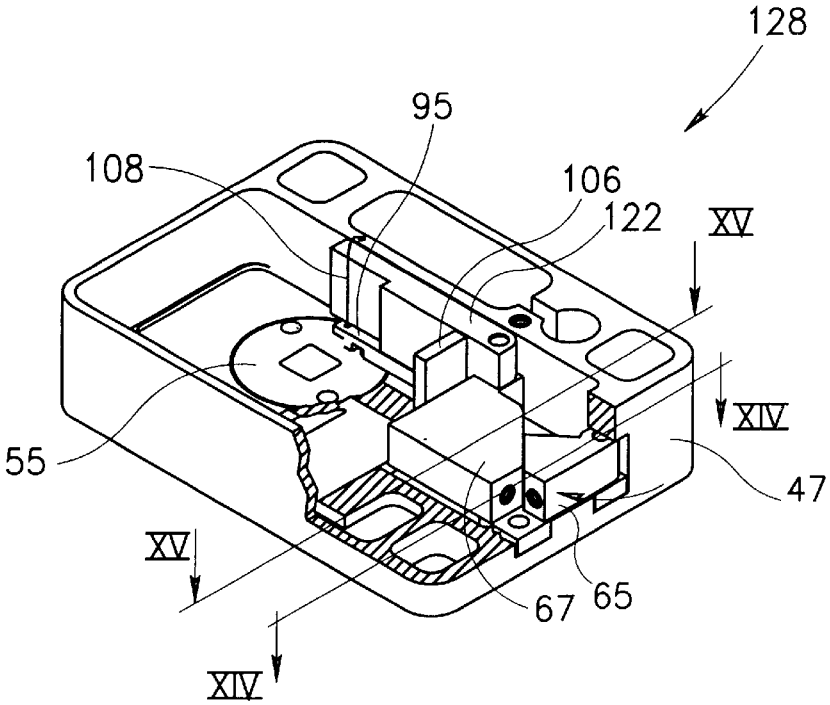

A magnetically latched solenoid 129 with an armature 131 is under the control of a controller 132 connected to a code entry means 133 (see FIG. 10). The armature 131 is reciprocable in a direction perpendicular to the direction of reciprocation of the lock bolt urging mechanism 128 between a retracted unblocking position and an outwardly biased blocking disposed toward either the lock bolt arresting member's intermediate or trailing portions 124 and 126 depending on the latter's position relative thereto.

Figure 16:
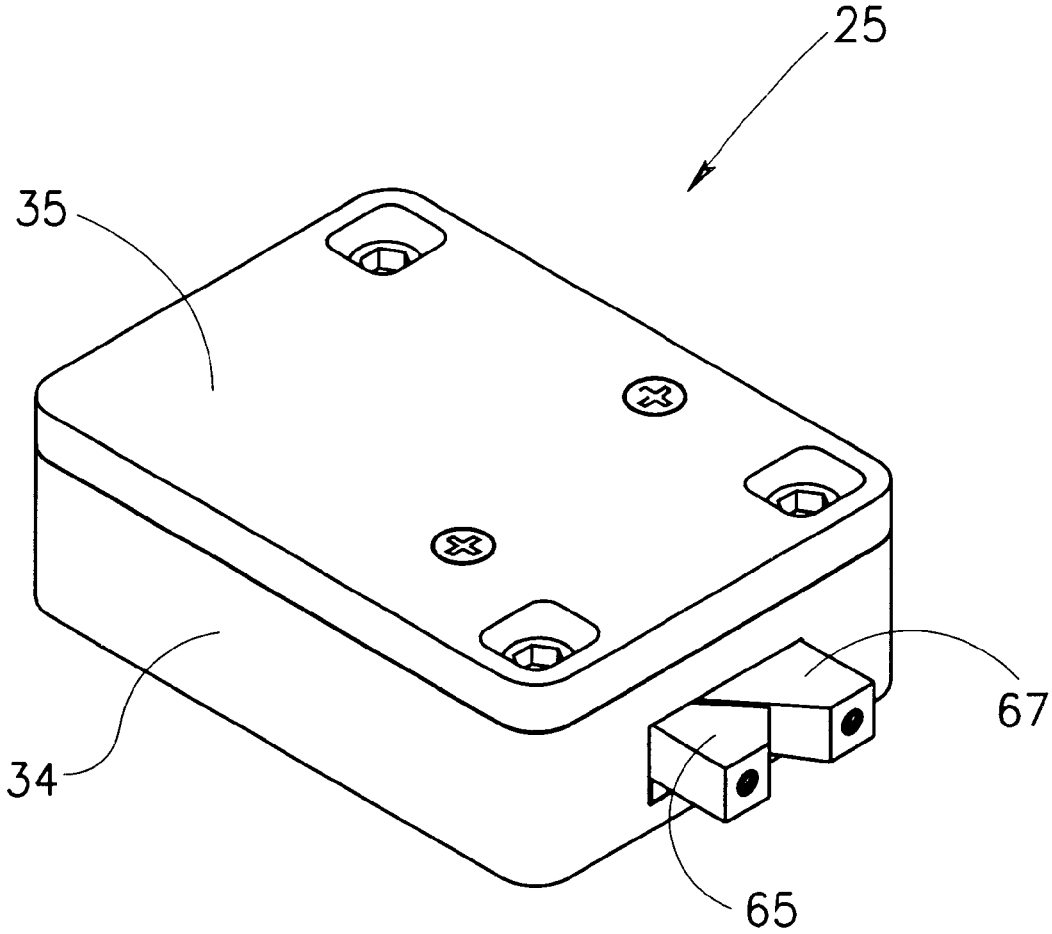
FIG. 16 is a perspective view of the lock of FIGS. 3 and 4 with its rotary lock bolt and its lock bolt urging member reversed for use with a clockwise operative handle driven bolt works mechanism.

FIG. 16 shows that tie lock 25 can be adapted for use with a clockwise operative bolt works mechanism by virtue of the positions of the rotary lock bolt 65 and the lock bolt urging member 67 be reversed. In this case, the rotary lock bolt 65 is rotatably mounted via a set screw inserted through the through bore 43 whilst the other two set screws received by the lock bolt urging member 67 are inserted through the bores 44 and 46 in the manner described above.

The operation of the lock 9 of FIG. 1 is now described with reference to FIGS. 17A–17F. In the normal state of the lock 9, the lock bolt 10 is in its protruding position, the lock bolt urging mechanism 128 is in its outwardly biased position, the carriage 95 is disposed toward the lock bolt aperture 49 and the solenoid armature 131 is its outwardly biased blocking position against the lock bolt arresting member's trailing portion 126 (see FIG. 17A). In the event of an attempted unauthorized entry, a force applied to the lock bolt 10 is mainly dissipated by means of the lock bolt urging member 67 being urged against different internal structures thereby considerably reducing the force applied against the armature 131.

Figure 17A:
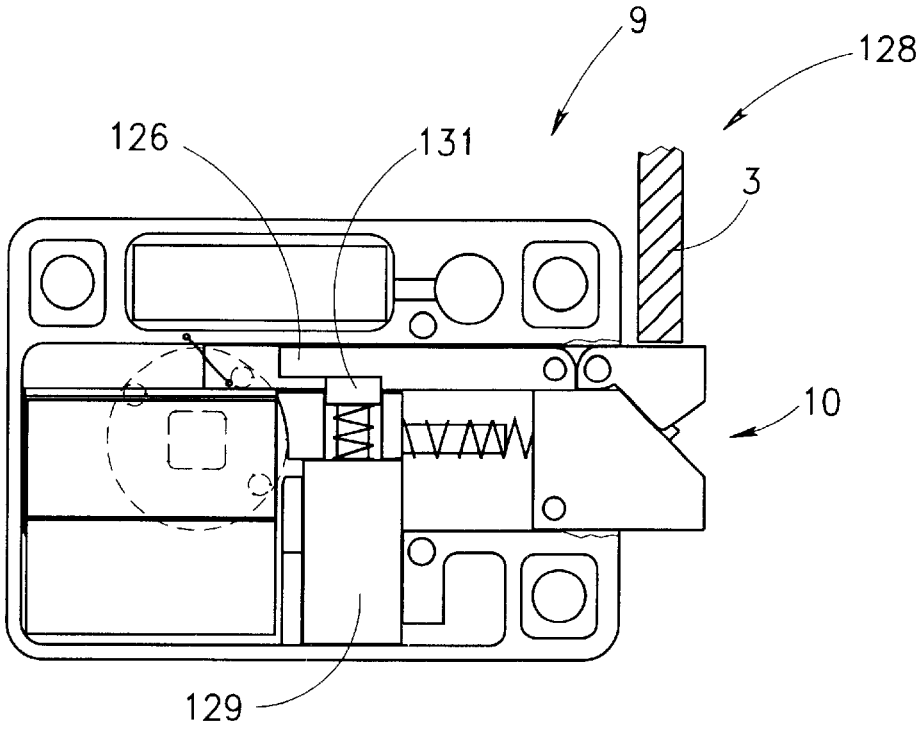
FIGS. 17A–17F illustrate a complete sequence of operation for unlocking and locking the safe door of FIG. 1.
Figure 17B:
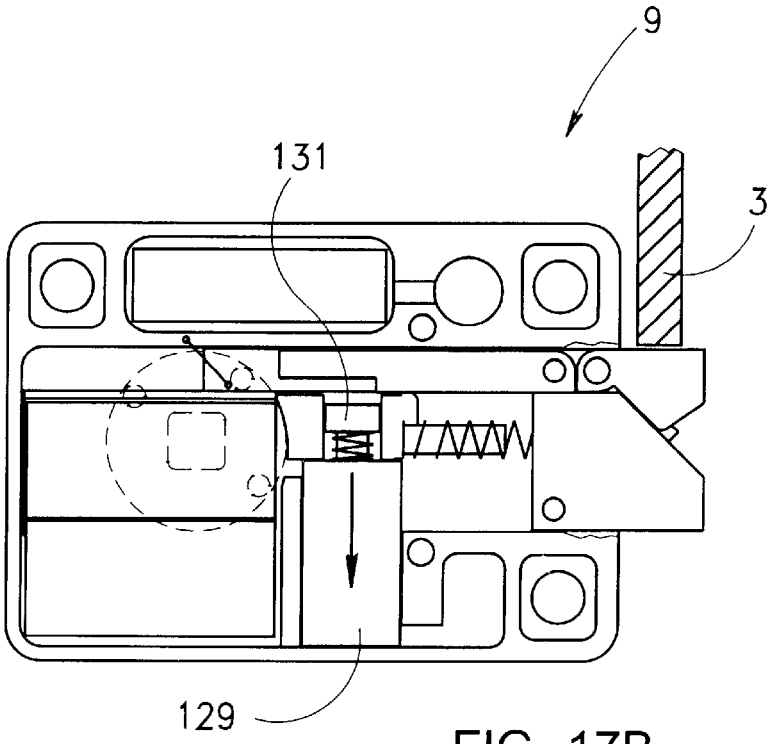
Figure 17C:
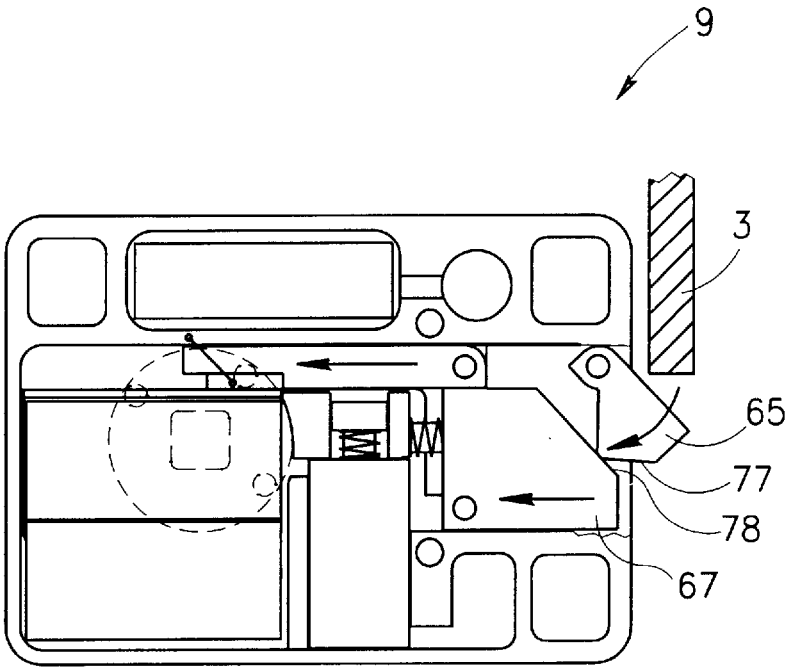
Figure 17D:
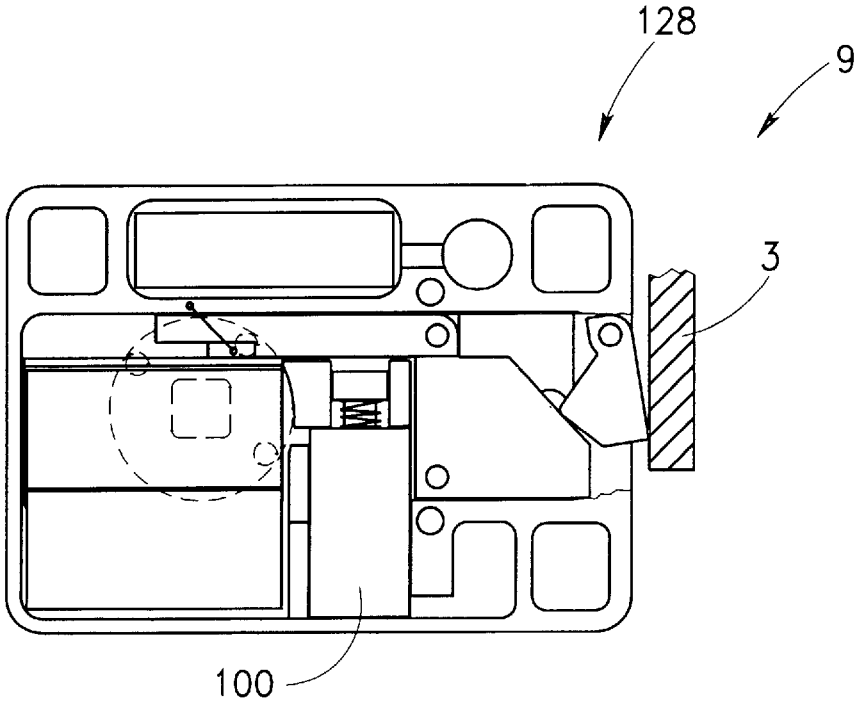
Figure 17E:
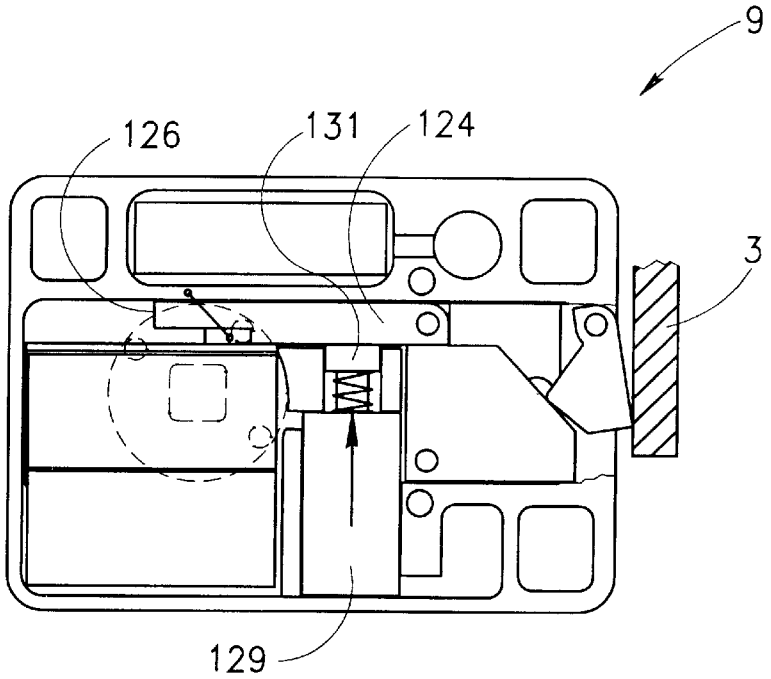
Figure 17F:
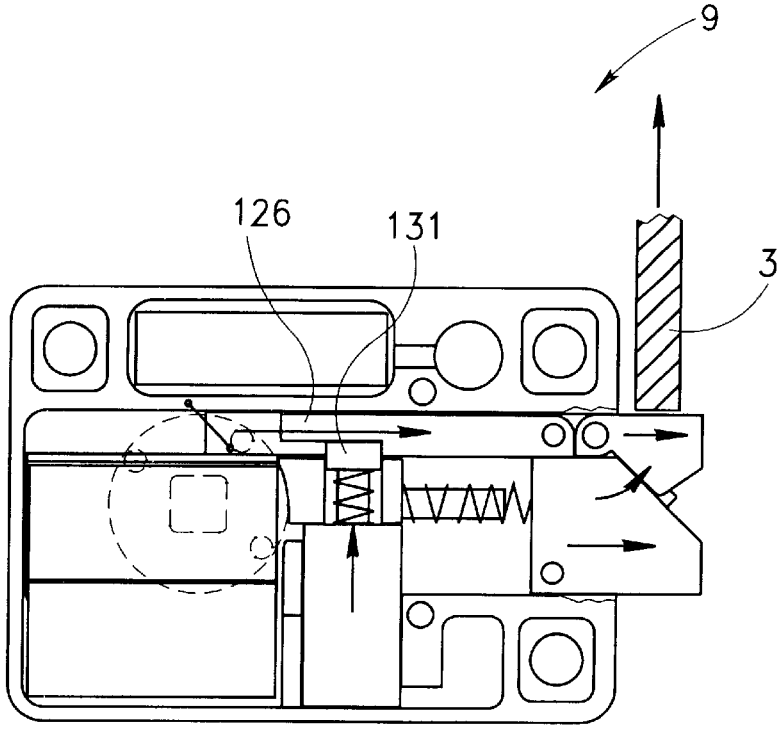

On entry of the access code, the solenoid 129 is activated whereby its armature 131 is magnetically latched into its retracted unblocking position (see FIG. 17B). The armature 131 is latched for sufficient time that the bolt works mechanism can be manipulated to open the safe door, namely, to displace the bolt works member 3 downward (see FIG. 17C) whereby the rotary lock bolt 65 is forcibly rotated to its retracted unlocking position causing the rearward displacement of the lock bolt urging mechanism 128 (see FIG. 17D). The force required to push the rotary lock bolt 65 into its retracted unlocking position gradually decreases because the force acts over a longer arm as the cam surface 77 slides along the abutment surface 78.

Whilst the safe door is opened, the solenoid 129 is activated a second time for urging its armature 131 to its outwardly biased blocking position. However, instead of the armatures 131 being biased against lock bolt arresting member's trailing portion 126, it is biased against its intermediate portion 124 because the rotary lock bolt 65 is retracted (see FIG. 17E). The armature 131 is biased against the trailing portion 126 when the bolt works mechanism is manipulated to displace the bolt 3 upward to lock the safe door (see FIG. 17F).

The operation of the lock 16 of FIG. 2 is now described with reference to FIGS. 18A–18F. In the normal state of the lock 16, the lock bolt 17 is in its protruding position, the lock bolt urging mechanism 128 is in its outwardly biased position, the carriage 95 is disposed toward the lock bolt aperture 49 and the armature 131 is its outwardly biased blocking position against the lock bolt arresting member's trailing portion 126 (see FIG. 18A). In this arrangement, the armature 131 takes up most of a horizontally force applied against lock bolt 17 in an attempted unauthorized opening of the lock.

Figure 18A:
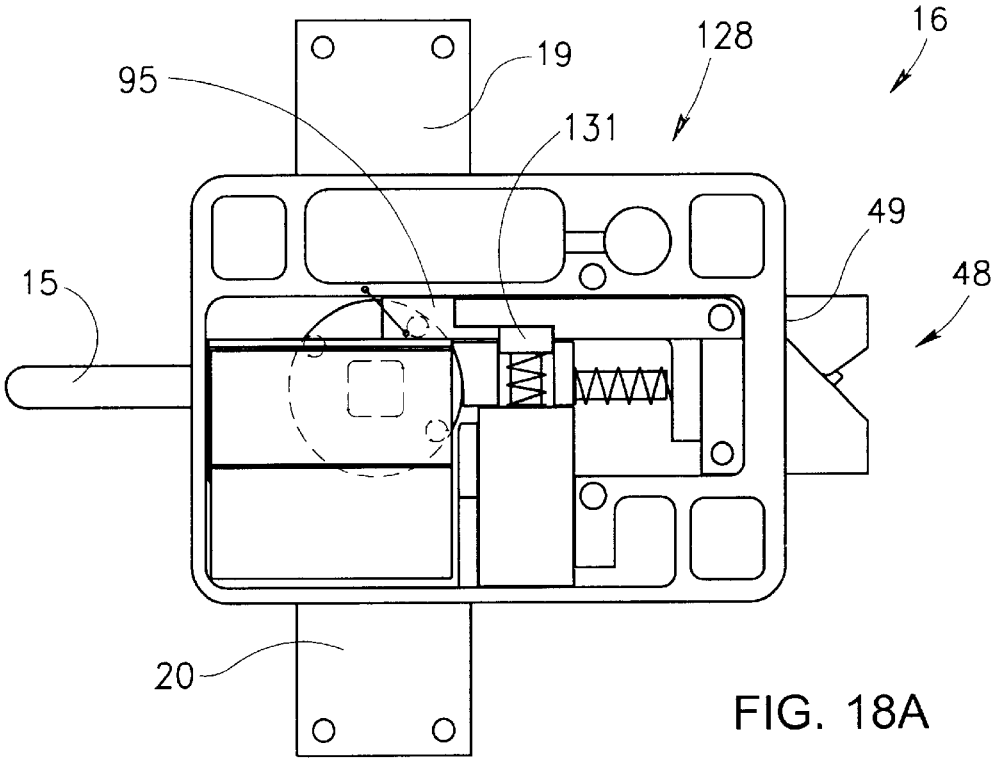
FIGS. 18A–18E illustrate a complete sequence of operation for the locking and unlocking of the safe door of FIG. 2.
Figure 18B:
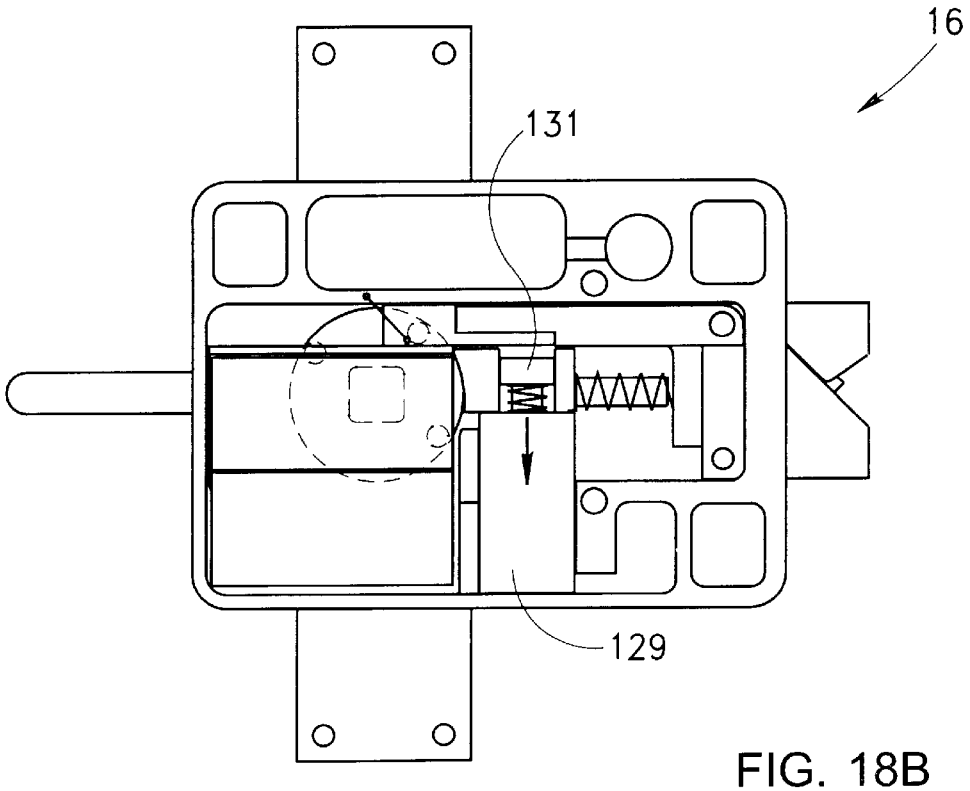
Figure 18C:
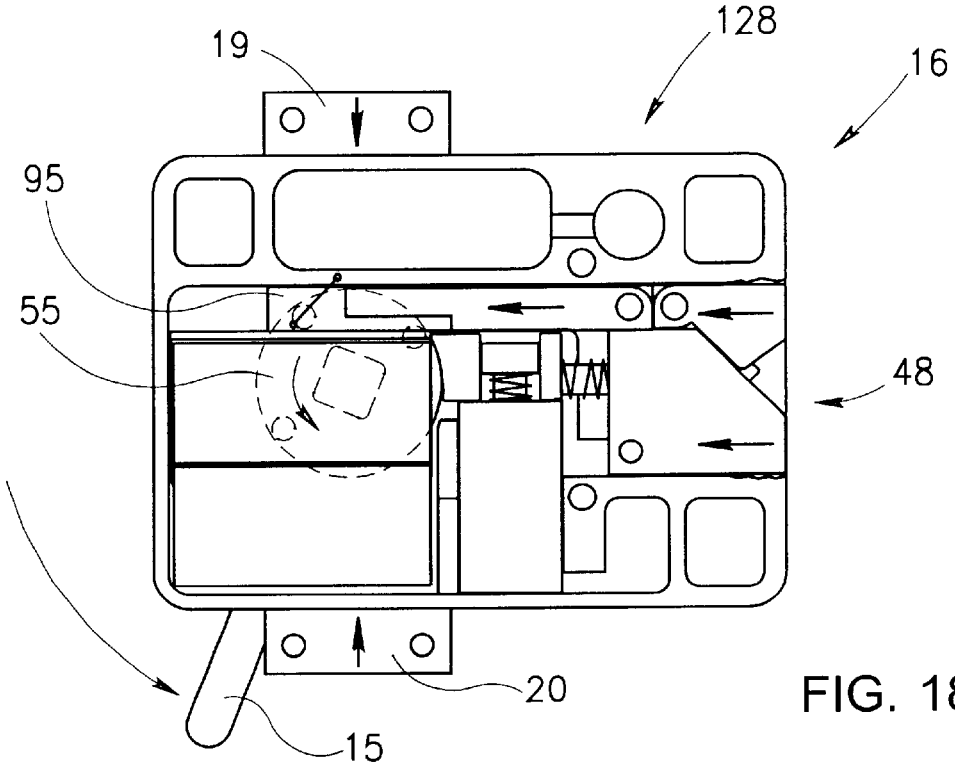
Figure 18D:
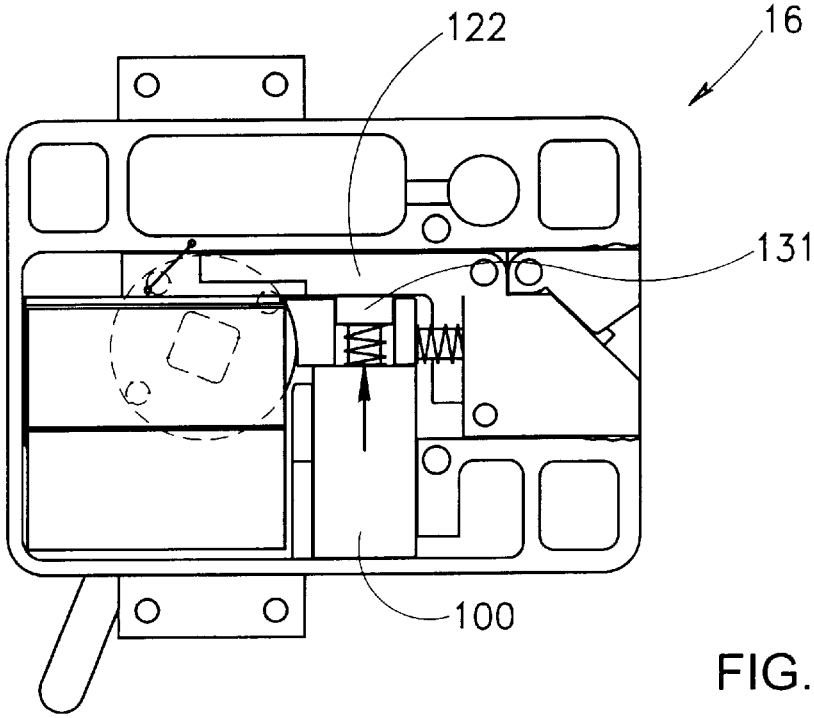
Figure 18E:
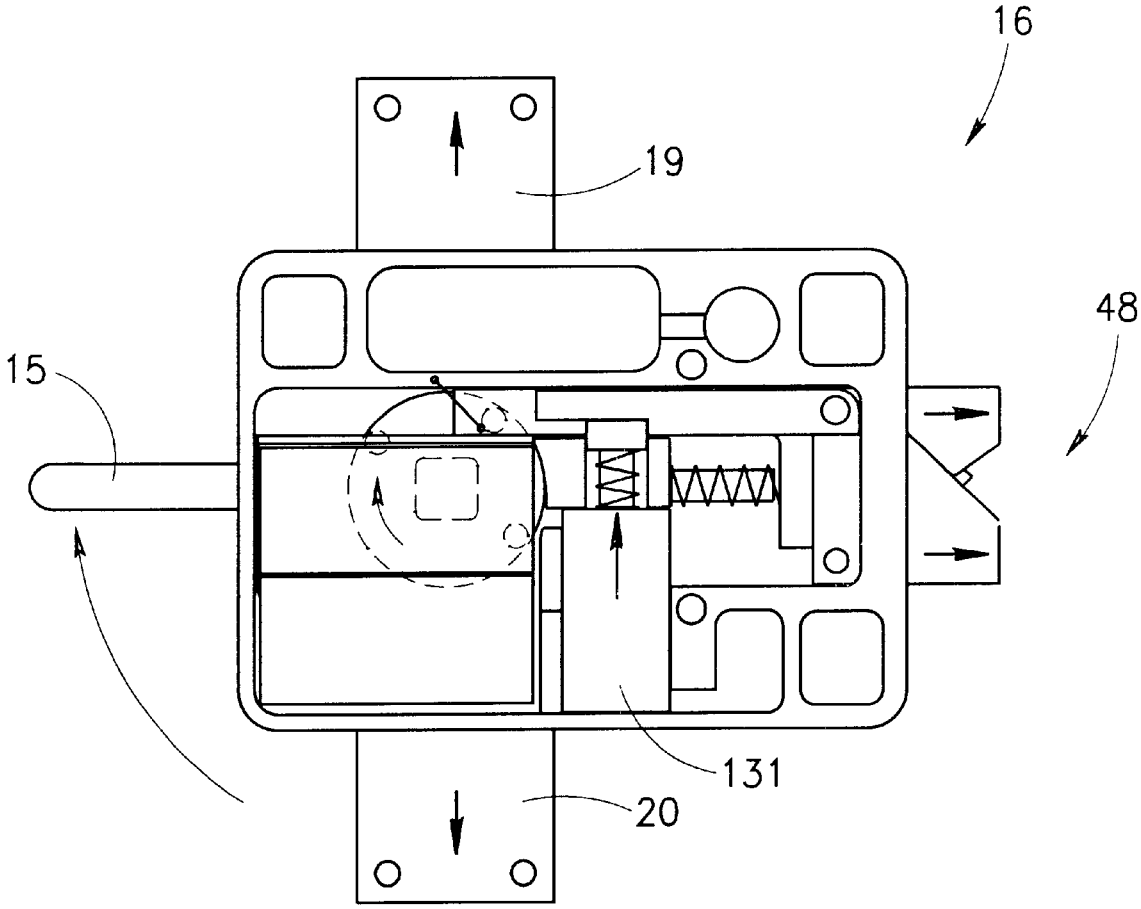

On entry of the access code, the solenoid 129 is activated whereby its armature 131 is magnetically latched in its retracted unblocking position (see FIG. 18B). The armature 131 is latched for sufficient time to open the safe door, namely, by rotating the handle 15 counterclockwise to urge the lock bolt 17 and the locking members 19 and 20 into their retracted unlocking positions (see FIG. 18C). On the urging of the rotary lock bolt 65 backwards, the lock bolt urging mechanism 128 merely rides with the movement of the carriage 95.

Once the door is open, the solenoid 129 is activated a second time for urging its armature 131 to its outwardly biased blocking position. However, instead of the armature 131 being biased against lock bolt arresting member's trailing portion 126, it is biased against the intermediate portion 124 because the rotary lock bolt 65 is in its retracted unlocking position (see FIG. 18D). The armature 131 is biased against the trailing portion 126 when the handle 15 is rotates clockwise to lock the safe door (see FIG. 18E).

Figure 19A:
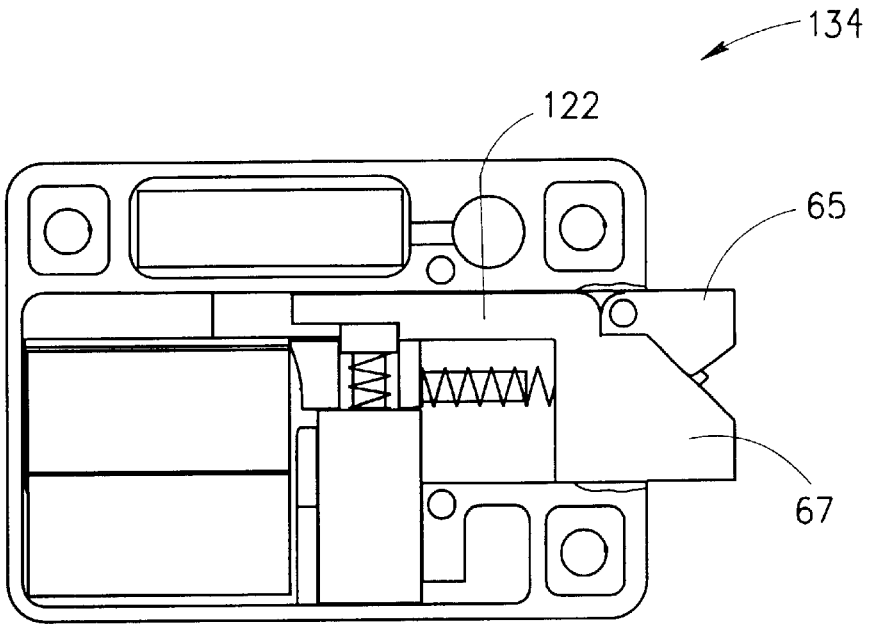
FIGS. 19A and 19B are top views of electromagnetic locking mechanisms of the present invention for use with counter-clockwise and clockwise operative bolt works mechanisms, respectively.
Figure 19B:
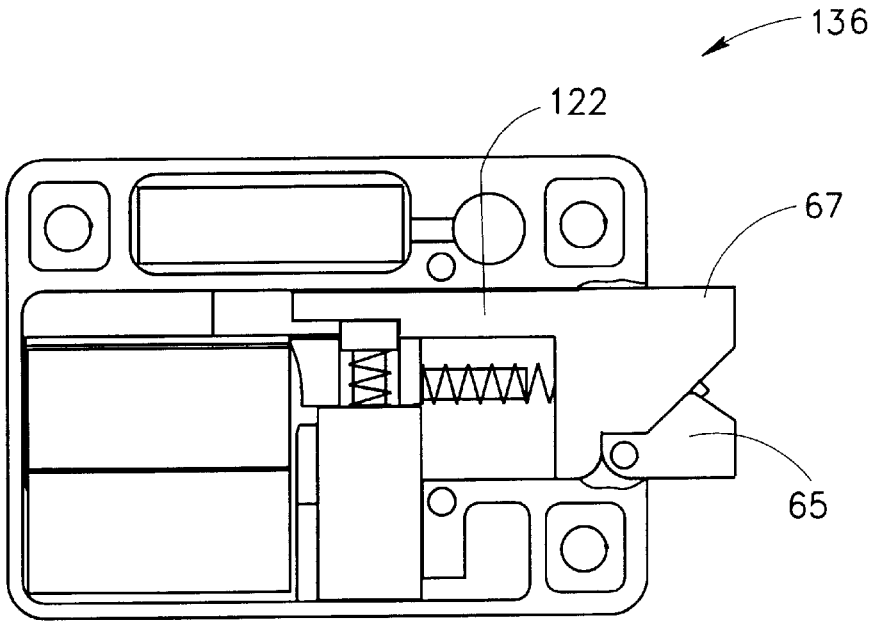
Figure 20A:
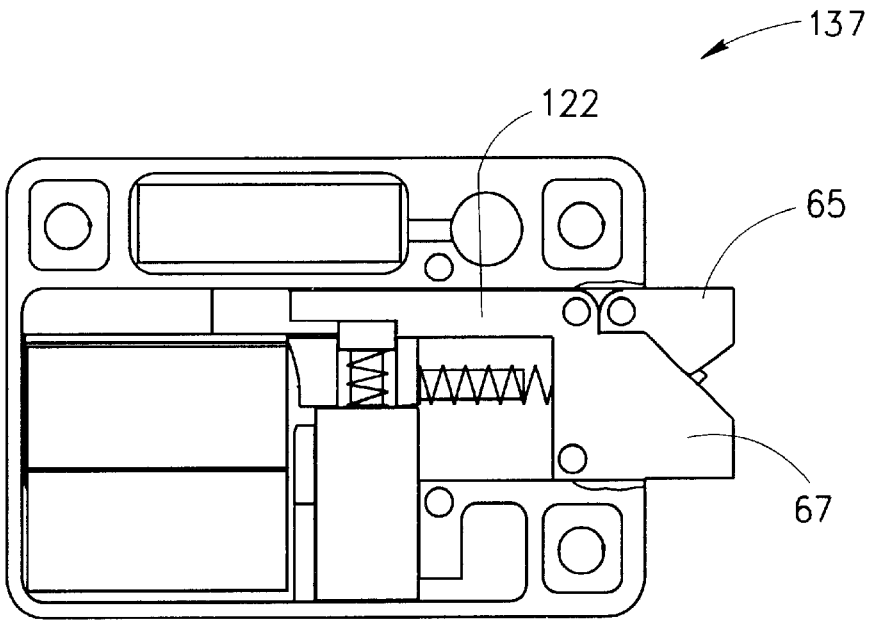
FIGS. 20A and 20B are top views of an electromagnetic locking mechanism of the present invention for use with either a counter-clockwise (FIG. 20A) or a clockwise operative bolt works mechanism (FIG. 20B).
Figure 20B:
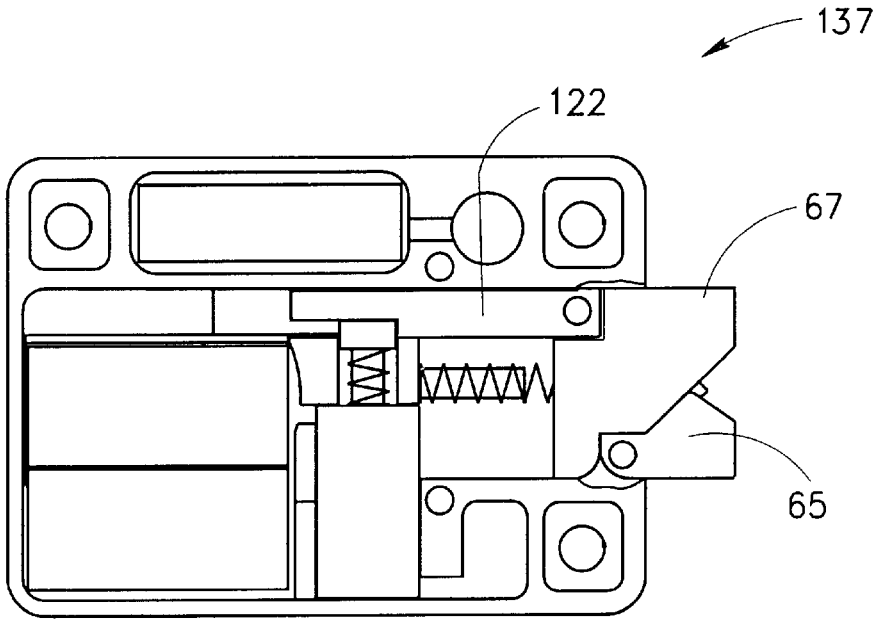

While the invention has been described with respect to a limited number of embodiments, it will be appreciated that many variations, modifications and other applications of the invention can be made without departing from the scope of the claims appended hereto. For example, FIGS. 19A and 19B show electromagnetic locking mechanisms 134 and 136 with their lock bolt urging members 67 integrally formed with their lock bolt arresting members 122 for use in counter-clockwise operative and clockwise operative bolt works mechanisms, respectively. FIGS. 20A and 20B show an electromagnetic locking mechanism 137 having its lock bolt urging member 67 detachably attached to its lock bolt arresting member 122 for use in a counter-clockwise operative bolt works mechanism (FIG. 20A) or a clockwise operative bolt works mechanism (FIG. 20B).

What is claimed is:

1. An electromagnetic locking mechanism comprising:

(a) a rotary lock bolt rotatably reciprocable between a normally protruding locking position relative to a lock bolt aperture and a retracted unlocking position on a forced rotation thereof by an external opening force;

(b) urging means for normally urging said rotary lock bolt to said normally protruding locking position;

(c) a blocking member reciprocable between a blocking position and an unblocking position for respectively preventing and enabling said forced rotation of said rotary lock bolt;

characterized in that said rotary lock bolt has a cam surface, said urging means is constituted by a lock bolt urging member having a leading portion with an abutment surface in continuous abutting engagement with said cam surface, and being linearly reciprocable from a normally protruding biased position relative to said lock bolt aperture for urging said rotary bolt to said normally protruding locking position to a retracted position in a single continuous movement during said forced rotation of said rotary lock bolt, said leading portion and said rotary lock bolt delimit an imaginary square having a diagonal substantially parallel to said abutment surface, and said blocking member prevents a rearward displacement of said lock bolt urging member from said normally protruding biased position to said retracted position in said blocking position and enables said rearward displacement in said unblocking position, further including electromagnetic means operatively coupled to said blocking member which when energized causes said blocking member to shift from said blocking position to said unblocking position.

2. The mechanism according to claim 1 wherein said abutment surface traverses said lock bolt aperture in said normally protruding biased position.

3. The mechanism according to claim 1 wherein said rotary lock bolt is substantially P-shaped.

4. The mechanism according to claim 1 wherein said abutment surface and said cam surface are formed with a groove and a matching projection for a more controlled sliding interengagement therebetween.

5. The mechanism according to claim 1 wherein said blocking member is operatively associated with a lock bolt arresting member coupled to said lock bolt urging member and is linearly reciprocable in a transverse direction to the direction of reciprocation of said lock bolt urging member.

6. The mechanism according to claim 5 wherein said lock bolt urging member and said lock bolt arresting member are integrally formed.

7. The member according to claim 5 wherein said lock bolt urging member is detachably coupled to said lock bolt arresting member whereby the positions of said rotary lock bolt and said lock bolt urging member are interchangeable such that the mechanism is capable for use with either a clockwise or a counterclockwise operative bolt works mechanism.

8. The mechanism according to claim 1 further comprising a handle operated carriage linearly reciprocable between outward and inward positions for selectively displacing said rotary lock bolt between said normally protruding locking position and a second retracted unlocking position and wherein said blocking member selectively enables a rearward displacement of said carriage from said outward position to said inward position.

9. A locking mechanism as set forth in claim 1, wherein said electromagnetic means is operatively coupled to a code entry means that permits the electromagnetic means to be energized only when a predetermined code is entered therein.

* * * * *